US005608946A

United States Patent [19]

Rennecker et al.

[11] Patent Number: 5,608,946

[45] Date of Patent: Mar. 11, 1997

[54] CONTROL CABLE AND WIRING ARRANGEMENT FOR A VACCUM CLEANER

[75] Inventors: David B. Rennecker; Timothy B. Hisrich, both of Canton; Gary L. Berkshire, Dover, all of Ohio

[73] Assignee: The Hoover Company, North Canton, Ohio

[21] Appl. No.: 440,998

[22] Filed: May 15, 1995

[51] Int. Cl.[6] ..... A47L 9/28

[52] U.S. Cl. ..... 15/339; 15/340.2; 15/410

[58] Field of Search ..... 15/410, 412, 339, 15/377, 350, 351, 340.2, 323

[56] References Cited

U.S. PATENT DOCUMENTS

| | | | |
|---|---|---|---|
| 1,264,073 | 4/1918 | Hoover . | |
| 1,955,967 | 4/1934 | Leathers | 200/157 |
| 1,989,868 | 2/1935 | Kessler | 183/51 |
| 2,009,455 | 7/1935 | Replogle | 15/351 |
| 2,104,453 | 1/1938 | Dow . | |
| 2,138,239 | 11/1938 | Irgens | 180/19 |
| 2,394,798 | 2/1946 | McNeal | 15/351 |
| 2,462,464 | 2/1949 | Brier et al. | 248/51 |
| 2,672,310 | 3/1954 | Rush | 248/51 |
| 2,738,538 | 3/1956 | Vance | 15/351 |
| 2,919,332 | 12/1959 | Descarries | 200/157 |
| 3,040,362 | 6/1962 | Krammes | 15/350 X |
| 3,175,282 | 3/1965 | Meeker et al. | 29/404 |
| 3,220,043 | 11/1965 | Lampe | 15/351 X |
| 3,226,758 | 1/1966 | Brown et al. | 15/350 X |
| 3,273,213 | 9/1966 | Zurkowski | 24/73 |
| 3,451,495 | 6/1969 | Bayless et al. | 15/340.2 X |
| 3,763,635 | 9/1973 | Schmitz | 55/374 |
| 4,182,618 | 4/1979 | Tschudy | 55/374 |
| 4,294,595 | 7/1980 | Bowerman | 55/213 |
| 4,446,594 | 6/1982 | Watanabe et al. | 15/323 |
| 4,654,924 | 4/1987 | Getz et al. | 15/377 X |
| 4,766,640 | 8/1988 | Martin et al. | 15/340 |
| 4,920,606 | 1/1989 | Gerke, Jr. et al. | 15/338 |
| 5,289,612 | 3/1994 | Glenn | 15/351 X |
| 5,459,901 | 10/1995 | Blase et al. | 15/377 X |

FOREIGN PATENT DOCUMENTS

| | | | |
|---|---|---|---|
| 908467 | 8/1972 | Canada | 74/417 |
| 137215 | 4/1985 | European Pat. Off. . | |
| 1276480 | 10/1961 | France . | |

OTHER PUBLICATIONS

Photograph –Dial–A–Matic™ cleaner, Model U6033–206 –Produced 5 Feb. 1979.

Photograph –Concept One™ cleaner, Model U3315–070 –Produced 14 Aug. 1987.

Photograph –PowerMAX™ cleaner, Model 3729–930 –Produced 22 May 1993.

*Primary Examiner*—Chris K. Moore

*Attorney, Agent, or Firm*—A. Burgess Lowe; Richardson B. Farley

[57] ABSTRACT

A vacuum cleaner includes an internal electrical supply cord and a control cable. These two elements are secured to a suction duct for mounting and guidance. The control cable also extends arcuately, smoothly around a lower motor-fan housing section to limit wear and kinking.

11 Claims, 5 Drawing Sheets

CONTROL CABLE AND WIRING ARRANGEMENT FOR A VACCUM CLEANER

BACKGROUND OF THE INVENTION

1. Field of the Invention

This invention relates to vacuum cleaners and, more specifically, to a vacuum cleaner having a power cable and electrical wiring array.

2. Summary of the Prior Art

The use of a control cable and/or wiring arrangement extending from the hand grip area of a cleaner to the motor or drive mounted in or closely adjacent to the nozzle of the cleaner are well known. In these cleaners, either or both the control cable and motor wiring have been led down the cleaner handle, led down within the cleaner hard bag, led down just outside a cleaner hard bag portion or even disposed within ducting for the cleaner. All of these arrangements suffer some disadvantage either from wanting a secure mounting or an easy or simplified attachment to the cleaner.

Since the use of an upwardly extending upper fill duct in a vacuum cleaner provides an obvious advantage from the standpoint of effective dirt bag filling and is also old and well known and desirable, it would seem that it might advantageously serve a secondary function, that of providing for the attachment and mounting of a control cable and/or cleaner motor wire on its external surface as these elements extend upwardly towards a cleaner hand grip, above their attachment to the lower disposed cleaner motor.

Accordingly, it is an object of the invention to utilize a vacuum cleaner suction air duct as a mounting means for a control cable.

It is an additional object of the invention to utilize a vacuum cleaner suction air duct as a mounting means for an electric wire for such cleaner.

It is a further object of the invention to provide an upper fill duct whose outer surface is used as an attachment and mounting means for a control cable and a cleaner motor wire.

It is an even further object of the invention to provide an arcuate guide means for the control cable below an upper fill duct to ease its transition for drive connection adjacent the motor housing.

It is an additional object of the invention to provide an improved mounting and attachment means for a control cable and/or electric wire for a vacuum cleaner.

SUMMARY OF THE INVENTION

A vacuum cleaner includes a hard bag housing disposed below its handle and within which is mounted an upper fill duct that extends upward within a bag cavity formed by the hard bag housing. This fill duct fits downwardly telescopically over an upward extension of a partially cylindrical section of a motor-fan housing disposed at the cleaner's hard bag housing bottom. This partly cylindrical portion mounts the motor-fan system for the hard bag cleaner. The fill duct is also screwingly attached adjacent its top so as to be mounted to the interior of the hard bag housing upwardly.

An electrical conductor and a control cable are disposed to extend generally from the top to the bottom of the bag cavity downwardly and also situated to extend along one side of the upper fill duct. A pair of vertically spaced side clamps on the duct trap the conductor and cable therein, with the lower of the two clamps opening inwardly towards the rear surface of the hard bag housing and the upper of the two clamps opening outwardly towards the bag cavity so that the conductor and cable are, in effect, interweaved between them. The clamps are sized so that their clamping jaws are spaced a distance apart to provide for the conductor being received clampingly elastically between them. The cable sheath is of a smaller diameter so that it is lodged beneath and inwardly of the electrical connector. This arrangement prevents it from beneath and inwardly of the electrical connector. This arrangement prevents it from escaping the clamps and also does not interfere with its operation since it is held relatively loosely by the two clamps, themselves.

The electrical conductor and control cable extend above the upper fill duct so as to extend towards the handle, as is conventional. At the bottom of the upper fill duct, the electrical connector includes a plug that plugs into a socket fixed in a top portion of a motor-fan housing section disposed inside lower portions of the hard bag housing.

The control cable also extends into this top portion of the motor housing section and then extends easily around an arcuate generally semicircular groove in its one end face to approximately the bottom of the partially cylindrical shaped the motor-fan housing section. It then emerges and passes over a relatively flat, somewhat vertical face of the motor-fan housing section to be finally be attached to a reciprocating clutch engaging piece for the hard bag cleaner.

BRIEF DESCRIPTION OF THE DRAWING

Reference may now be had to the accompanying Drawings for a better understanding of the invention, both as to its organization and function, with the illustration showing a preferred embodiment, but being only exemplary, and in which.

DETAILED DESCRIPTION OF THE INVENTION

Figure 1:
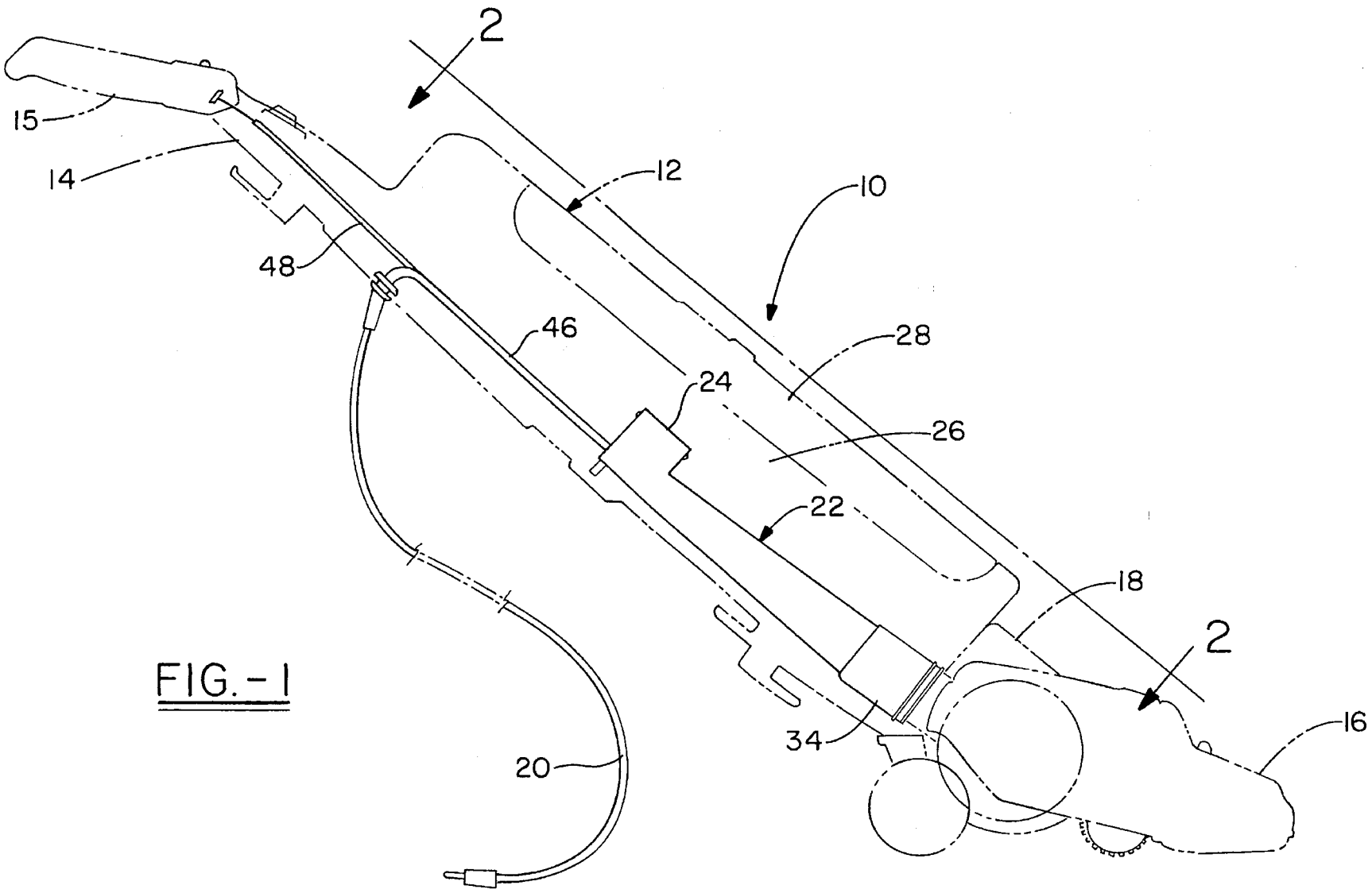
FIG. 1 is a side elevational view of the invention and illustrating the hard bag cleaner in phantom.
Figure 2:
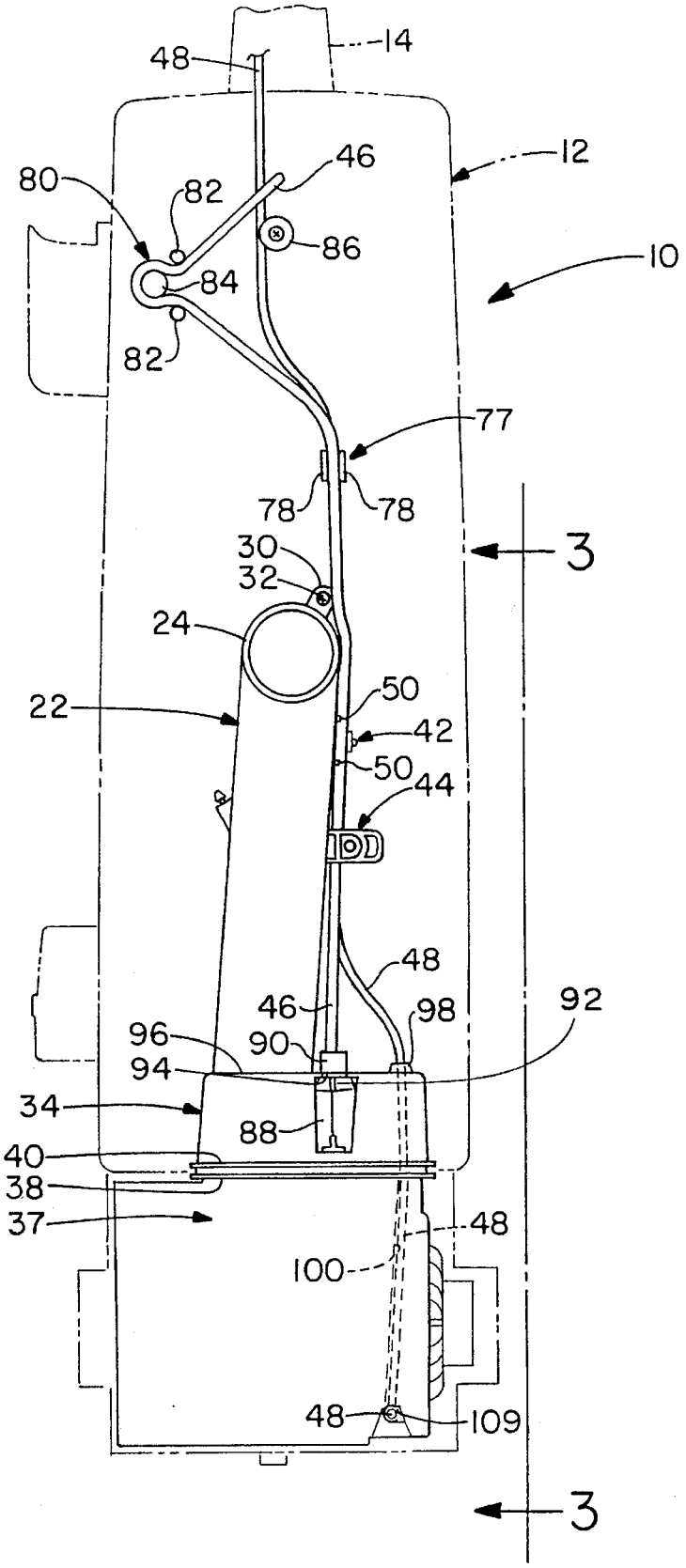
FIG. 2 is a frontal elevational view as may be taken at line 2—2 of the hard bag cleaner, i.e., with the bag door of the hard bag cleaner removed.
Figure 3:
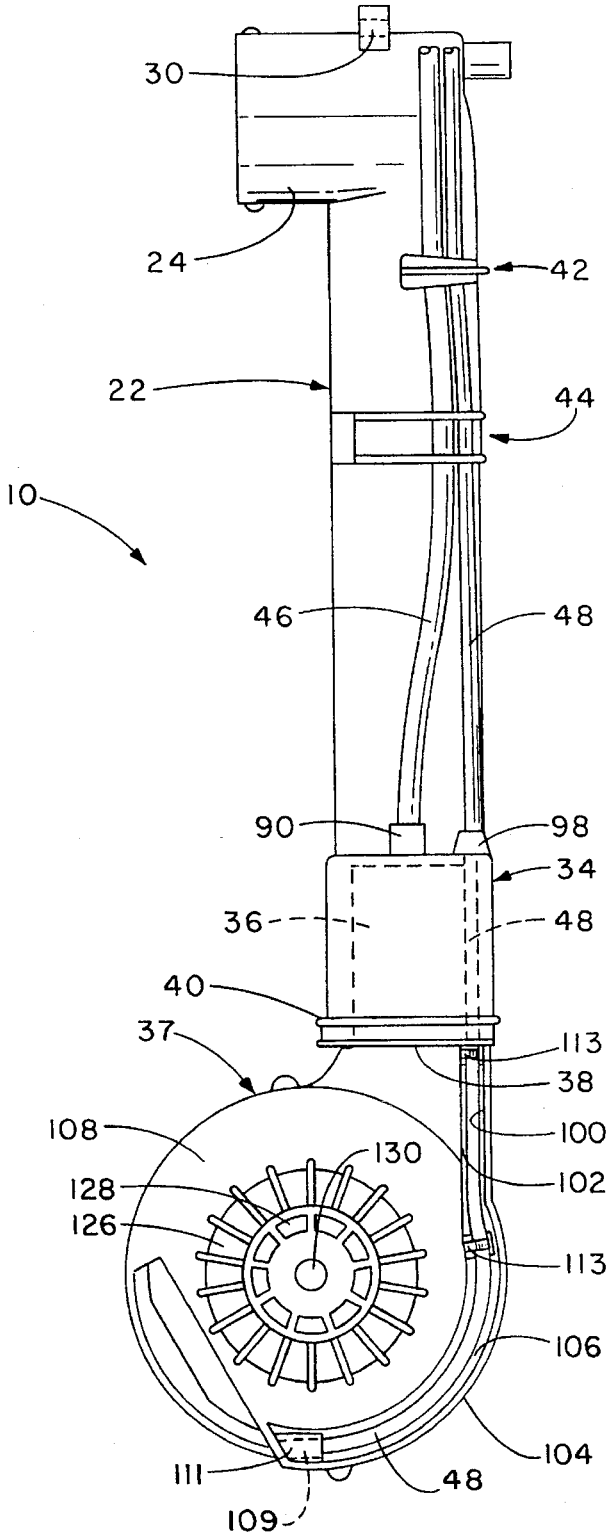
FIG. 3 is a side elevational view of the invention as may be taken at line 3—3 of FIG. 2.
Figure 4:
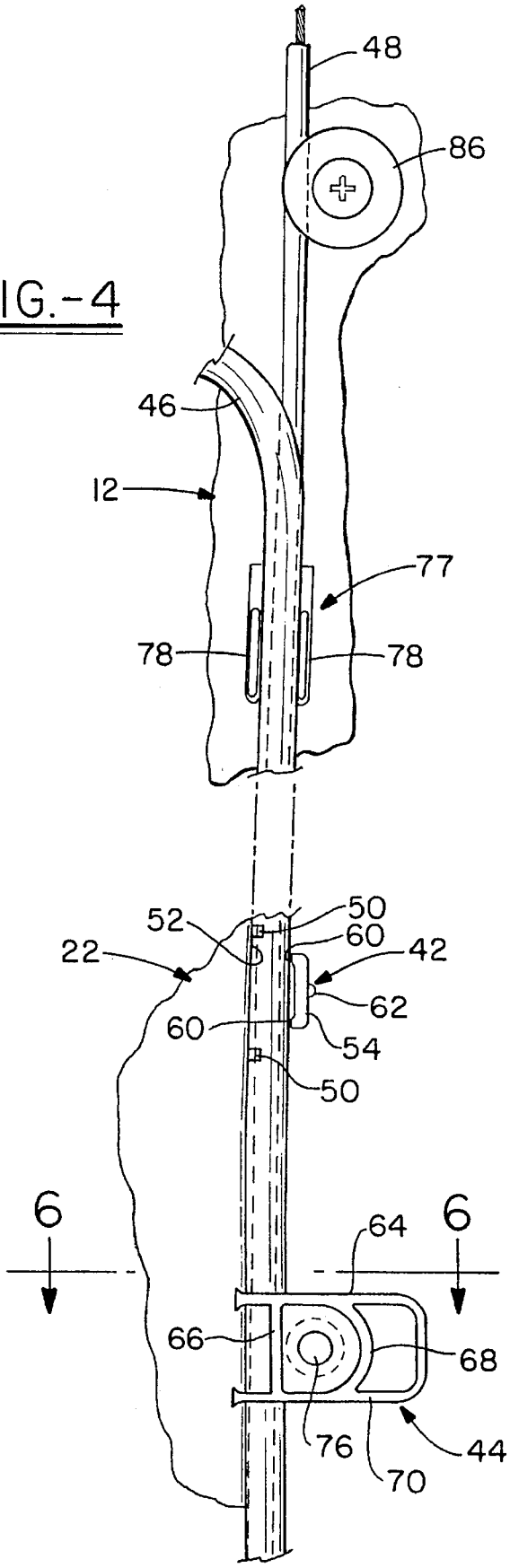
FIG. 4 is a partial frontal elevational view illustrating the electric cord and control cable duct connecting means.
Figure 5:
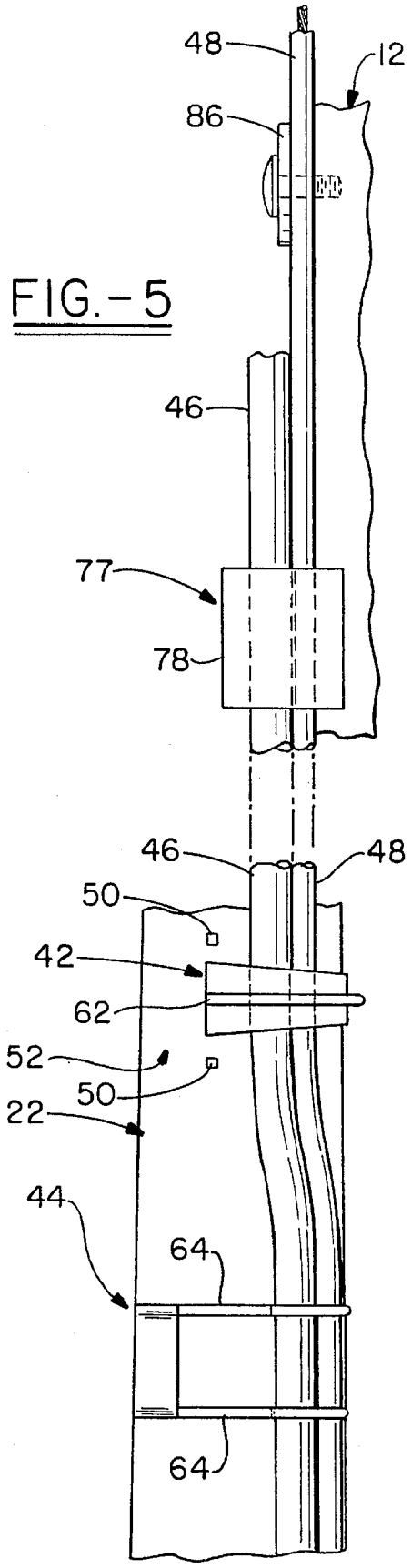
FIG. 5 is a side elevational view of the cord and cable duct connecting means shown in FIG. 4.
Figure 6:
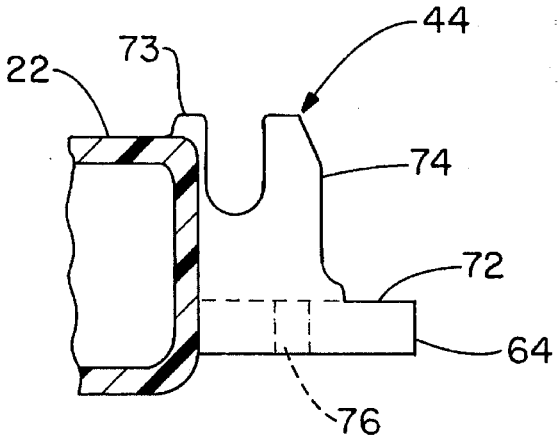
FIG. 6 is a plan view of the lower cord and cable connecting means and may be taken at line 6—6 of FIG. 4.
Figure 7:
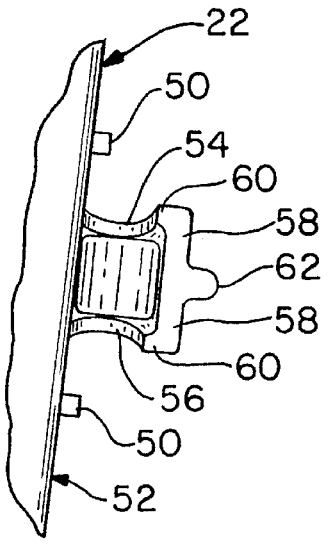
FIG. 7 is a view of the upper cord and cable connecting means of FIG. 4 but with the cord and cable removed.
Figure 8:
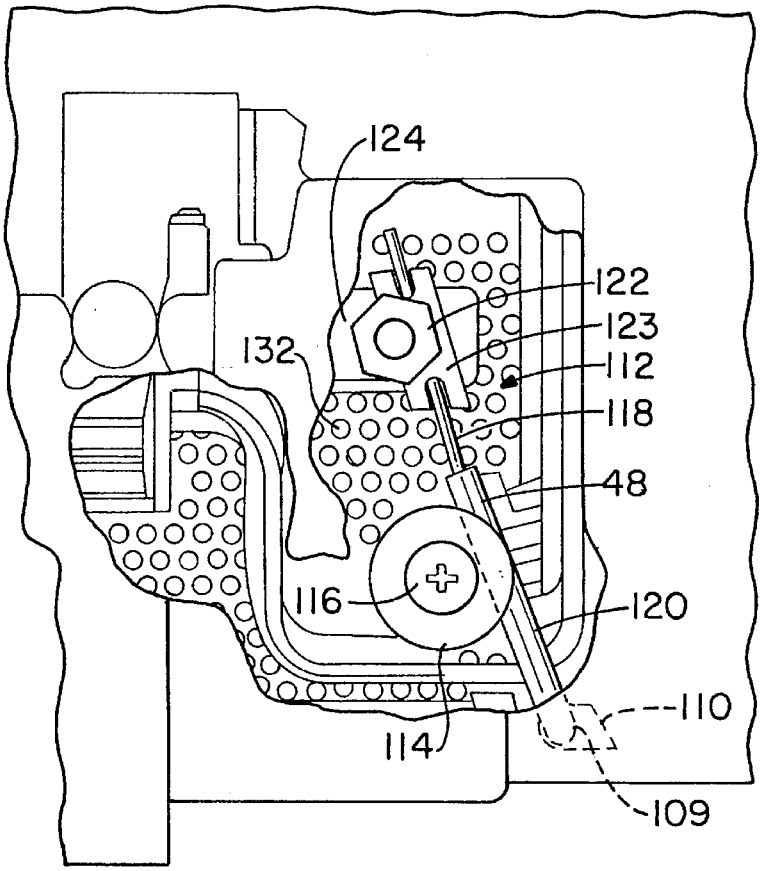
FIG. 8 is a view of the control cable and its connection to the clutch actuating means as may be taken from the left bottom side of FIG. 3.

There is shown in FIG. 1 a vacuum cleaner 10, taking the form in this embodiment of the invention of a power assisted vacuum cleaner, having a hard bag housing 12, a handle 14 fixed to and extending upwardly from the hard bag housing 12, a movable hand grip 15 surmounting the handle 14, and a nozzle 16 pivotally attached to lower reaches of the hard bag housing 12. The hard bag housing 12 includes a fan-motor housing section 18 at its bottom and an external electrical cord 20 entering the vacuum cleaner 10 near the top of the hard bag housing 12.

Within the hard bag housing 12 is disposed an upper fill duct or tube 22 which communicates forwardly by a mounting snout 24 with bag cavity 26 formed in hard bag housing 12. A bag (not shown) may conventionally be mounted on the mounting snout 24. A bag door 28 closes front portions of the bag cavity 26 and completes the outline of the hard bag housing 12.

Turning now to the remainder of the Figures, it can be seen that the upper fill duct or tube 22 extends generally medially upwardly within hard bag housing 12 and is attached thereto, at its top, by an integral tab 30 that is screwed by screw 32 to boss or the like (not shown) extending outwardly into the bag housing cavity 26 and integral with hard bag housing 12. At its lower end the upper fill tube takes the form of a downwardly opening approximately rectangularly shaped prism 34 which engages over a somewhat similar shaped hollow projection 36 of an integral motor-fan housing section 37. A lower lip 38 and an upper rim lip 40 on upper fill duct 22 are received above and below a floor (not shown) formed partly by a lower portion of the hard bag 12 and an upper flat portion of motor-fan housing cover (not shown) partially covering motor-fan housing section 37.

Above the lower mounting for the upper fill duct 22, it includes two sidewardly extending, upper and lower clamps 42 and 44, respectively. These clamps are integral with the upper fill duct 22 and serve to locate and mount an interior electric cord section 46 and a power or push-pull control cable 48. The interior electric cord section 46 is conventional, while the power or control cable 48 serves like a Bowden wire to transfer movement of the hand grip 15 downwardly towards the bottom of the hard bag housing 12. The clamping fingers (to be described later) of the upper and lower clamps 42, 44 are spaced sufficiently far apart to receive the push-pull control cable 48 loosely therebetween so it is inserted first into these two clamps to lie against the inner face of the rear side of the hard bag housing 12. The inner electric cord section 46 is then expansively forced between the clamping fingers of upper and lower clamps 42, 44 to securely mount it and trap the control cable 48 along upper fill duct 22.

Upper clamp 42 includes a pair of spaced horizontally extending, small, integral rectangularly shaped pips 50, 50 extending sidewardly from a side 52 of upper fill duct 22. Disposed medially between the two rectangularly shaped pips 50, 50 is an outwardly opening, right angled clamp arm 54 that is integrally attached to the side 52 upper fill duct 22 inwardly of these pips. This right angled arm forms an integral sidewardly extending attaching arm 56 and a horizontally extending clamp arm 58 integral with it. Clamp arm 58 is horizontally ribbed at its upper and lower sides by small ribs 60, 60 that extend inwardly towards fill duct 22 and, generally, the full depth of clamp arm 58. The upper clamp 42 is complete by a medially, disposed, horizontally extending, integral strengthening rib 62 shown disposed on the outside of clamp arm 58 and extending fully around (not shown) the remainder of right angled clamp arm 54 to slightly overlap (not shown) the inner side of upper fill duct 22. All to strengthen right angled clamp arm 54

Lower clamp 44 is formed by a main, sidewardly extending tab 64 which is rounded on its end and upwardly ribbed by straight rib 66 and arcuate rib 68 both of which terminate in a peripheral tab border 70 so that a strong lattice like structural network for the tab 64 is formed. Beneath an inward face of an inward full side 72 of the tab 64 which is situated below the lattice like network, a pair of vertically spaced, parallel clamp arms 73, 74 extend inwardly towards the rear side of the hard bag housing 12. A hole 76 in tab 64 might also be used to mount the upper fill tube 22. Part of the additional strengthening afforded the tab 64 by its ribbing is provided for its elongated cantilevered length, the outer portion of which may be utilized to trap a vertically extending motor mounted switch actuating rod (not shown). U.S. Pat. No. 5,226,527, issued Jul. 13, 1993 and owned by a common assignee illustrates such a switch actuating rod. Reference may be had to this patent to a further teaching of this structure.

The electric cord section 46 is first received clampingly in the lower clamp 4 and the control cable 48, in turn, is trapped against the bag housing back side (not shown).

The upper clamp 42 first receives the control cable 48 and then the inner electric cord section 46 which is resiliently compressingly therein by the action of the functioning clamping fingers. The fingers of the upper clamp are the duct 22 and the ribs 60, 60; the fingers of the lower clamp are the surfaces of the sides of the clamp arms 73, 74.

Above the upper fill duct 22, the control cable 48 and interior electric cord section 46 pass through a clamp 77 formed by integral arms 78, 78 outwardly extending from the rear inner surface of the hard bag housing 12. These two arms are spaced to elastically grip the electric cord section 46 and to relatively loosely receive the control cable 48.

Above the clamping arms 78, 78 of the hard bag housing 12, the interior electric cord section 46 and control cable 48 diverge. Cord section 46 passes through strain relief 80, formed by closely spaced circular bosses 82, 84, 84 and thence outwardly (not shown) of the cleaner 10 to form a continuous continuation with electric cord 20. Control cable 48 passes by a washered guiding boss 86 and thence into the handle 14 to be attached to the hand grip 15 for reciprocating actuation by it.

Near the bottom of the upper fill duct 22 the electric cord section 46 mounts a plug 88 that includes an upper truncated conical section 90 followed by a T-section 92 that closes a plug slot 94 in a top 96 of dirt duct rectangular prism 34. Below the T-section the plug 88 is shaped conventionally. It furnishes an electrical connector between electric cord section 46 and the cleaner motor (not shown) housed in motor-fan housing section 37.

The control cable 48 also extends through the top 96 of dirt duct rectangular prism 34, with a duct integral hollow boss 98 helping orient and provide additional bearing surface for the power cable in its passage through top 96. Below this top it extends along a generally vertical groove 100 having a straight groove portion 102 formed in a side of rectangular prism portion 36 of fan motor housing 37. This groove portion terminates at a cylindrical housing portion 104 of the fan motor housing section 37 where a sidewardly disposed, arcuate groove portion 106 extends approximately ⅓ of the way around an end face 108 of cylindrical housing portion 104 to terminate at about the bottom of this cylindrical portion. The power cable 48 snap fits into these grooves because of the bend imparted to it and because of slightly inset ribs 113, 113 which extend outwardly relative to motor-fan housing section 37 in vertical groove 100 and arcuate groove 106. Their top faces angle inwardly relatively to the centers of these grooves. They are generally right angle triangular in cross section and also are spaced outwardly relative to cut outs (unnumbered) in the bottom of the grooves so that power cable 48 moves behind them as it is mounted in these grooves to be received fixedly in the grooves adjacent their inner bottoms. The power cable 48 then extends outwardly through an aperture 109 in a small flat end segment 110 of an integral short tube 111 integral with cylindrical housing portion 104. Above this small flat segment, it is held against a larger, flattened inset face 112 of cylindrical housing portion 104 by a washer 114 and screw 116. This inset provides clearance for the control cable 48. A core 118 of the control cable 48 extends outwardly of its sheath 120 beneath the washer 114 to be attached by a tightened nut 122 and washer 123 to a power drive cleaner clutch engaging means 124. Such a clutching means and its drive arrangement is generally seen in U.S. Pat. No. 3,581,591, issued Jun. 1, 1971 and owned by a common assignee. Reference may be had to this patent for a more thoroughgoing understanding of the power train of at least one conventional power assisted cleaner.

The general arrangement of the control cable 48 in the arcuate groove portion 106 provides a smooth transition for this cable to its connection location with the clutching means so that it neither tends to wear too much from flexure or, worse, to become inoperative due to kinking.

The end face 108 of cylindrical housing portion is seen to also include inner and outer ventilating slot arrays 126, 128, respectively and a bore 130 for mounting of a fan-motor shaft (not shown). Ventilation perforations 132 are also provided in enlarged inset face 112.

It should be clear from the foregoing that all the objects of the invention set out at the beginning portion of the description have been met. It should also be obvious that many modifications could be made to the structure described would still fall within its spirit and purview.

What is claimed is:

1. A vacuum cleaner including:

a) an upwardly extending hard bag housing portion;

b) a suction duct extending upwardly in said vacuum cleaner within said upwardly extending hard bag housing portion;

c) an electrical cord extending downwardly in said cleaner; and d) said electrical cord disposed outside said suction duct within said hard bag housing portion and lying at least partly along said suction duct and attached thereto for secure mounting.

2. The vacuum cleaner of claim 1 wherein:

a) a control cable extends downwardly in said vacuum cleaner inside said upwardly extending housing portion; and b) said control cable also lies at least partly along said suction duct and is attached thereto for secure mounting.

3. The vacuum cleaner of claim 1 wherein:

a) a means for clamping said electrical cord to said suction duct provides said attachment.

4. The vacuum cleaner of claim 3 wherein:

a) said means for clamping said electrical cord includes a pair of spaced clamps are provided along said suction duct; and b) said pair of spaced clamps opening in opposite directions to provide an interleaving effect to said electrical cord.

5. The vacuum cleaner of claim 4 wherein:

a) a control cable is also disposed in said clamping means.

6. The vacuum cleaner of claim 5 wherein:

a) at least a part of said clamping means receives said electrical cord in overlying relationship to said control cable;

b) whereby said electrical cord maintains said control cable in said clamping means.

7. A power assisted vacuum cleaner including:

a) a suction duct extending away from a reciprocating actuating hand grip for said power assisted cleaner in, said power assisted vacuum cleaner;

b) a control cable attached to said reciprocating actuating hand grip and extending within said power assisted vacuum cleaner away from said actuating hand grip to reciprocate therewith; and c) said control cable lying at least partly along said suction duct and attached thereto for secure mounting.

8. A vacuum cleaner including:

a) an outer shell;

b) an electrical cord extending downwardly within said outer shell of said vacuum cleaner;

c) a control cable extending upwardly in said outer shell of said vacuum cleaner adjacent said electrical cord;

d) a means for clamping said electrical cord to said vacuum cleaner disposed adjacent said electrical cord;

e) said control cable disposed inwardly in said means for clamping said electrical cord;

f) said electrical cord disposed outwardly of said control cable in said means for clamping said electrical cord, relative to said control cable, whereby said electrical cord maintains said control cable in said means for clamping said electrical cord.

9. A power assisted vacuum cleaner including:

a) a control cable extending downwardly into said power assisted cleaner from an actuating handle of said power assisted vacuum cleaner;

b) a fan-motor housing section disposed at the bottom of said power assisted vacuum cleaner; and c) an arcuate groove means for guiding said control cable formed around at least a portion of said fan-motor housing section.

10. The vacuum cleaner of claim 9 wherein:

a) said arcuate groove means is formed by a two sided arcuate groove situated in an end piece of said motor-fan housing section.

11. The vacuum cleaner of claim 1, wherein:

a) said duct is an upper fill duct extending upwardly in said hard bag housing portion.

* * * * *